US007652683B2

(12) United States Patent
Akagawa et al.

(10) Patent No.: US 7,652,683 B2
(45) Date of Patent: Jan. 26, 2010

(54) LINE HEAD AND IMAGE-FORMING APPARATUS

(75) Inventors: Suguru Akagawa, Suwa (JP); Shinichi Yotsuya, Chino (JP)

(73) Assignee: Seiko Epson Corporation (JP)

( * ) Notice: Subject to any disclaimer, the term of this patent is extended or adjusted under 35 U.S.C. 154(b) by 158 days.

(21) Appl. No.: 11/492,715

(22) Filed: Jul. 24, 2006

(65) Prior Publication Data

US 2007/0025765 A1 Feb. 1, 2007

(30) Foreign Application Priority Data

Jul. 26, 2005 (JP) ..... 2005-215529

(51) Int. Cl.
*B41J 2/45* (2006.01)

(52) U.S. Cl. ..... 347/238

(58) Field of Classification Search ..... 347/238, 347/122, 130, 224, 230, 241, 244, 256, 258; 257/98, 788–795; 438/69, 72; 359/619; 385/31

See application file for complete search history.

(56) References Cited

U.S. PATENT DOCUMENTS

| | | | | |
|---|---|---|---|---|
| 5,408,547 | A | 4/1995 | Lebby et al. | |
| 6,781,762 | B2 * | 8/2004 | Ozawa | 359/619 |
| 7,129,965 | B2 | 10/2006 | Iwamatsu et al. | |
| 7,158,161 | B2 * | 1/2007 | Gyoutoku et al. | 347/130 |
| 7,463,275 | B2 * | 12/2008 | Nakamura et al. | 347/224 |
| 2004/0161192 | A1 * | 8/2004 | Hamano et al. | 385/31 |
| 2004/0211971 | A1 * | 10/2004 | Takei et al. | 257/98 |
| 2006/0181603 | A1 * | 8/2006 | Ogura et al. | 347/238 |

FOREIGN PATENT DOCUMENTS

| | | | |
|---|---|---|---|
| JP | 01-085846 | | 6/1989 |
| JP | 02184467 | A * | 7/1990 |
| JP | 6-268817 | | 9/1994 |
| JP | 2003-025632 | | 1/2003 |
| JP | 2003-149470 | | 5/2003 |
| JP | 2003-205646 | | 7/2003 |
| JP | 2003-282255 | | 10/2003 |
| JP | 2003291406 | A * | 10/2003 |
| JP | 2005-032492 | | 2/2005 |
| JP | 2005-101559 | | 4/2005 |
| JP | 2005-119104 | | 5/2005 |
| JP | 2005-123057 | | 5/2005 |

* cited by examiner

*Primary Examiner*—Hai C Pham
(74) *Attorney, Agent, or Firm*—Harness, Dickey & Pierce, P.L.C.

(57) ABSTRACT

A line head includes: a first substrate having a plurality of organic electroluminescent devices; a bonding layer disposed on the first substrate and having optical transparency; a second substrate bonded to the first substrate with the bonding layer therebetween and having a reflective film that covers at least a part of the bonding layer; and a plurality of exit portions respectively from which light that has passed through the bonding layer is exited, the light emitted from the organic electroluminescent devices.

10 Claims, 12 Drawing Sheets

LINE HEAD AND IMAGE-FORMING APPARATUS

CROSS-REFERENCE TO RELATED APPLICATION

This application claims priority to Japanese Patent Application No. 2005-215529, filed Jul. 26, 2005, the contents of which are incorporated herein by reference.

BACKGROUND

1. Technical Field

The present invention relates to a line head and an image-forming apparatus.

2. Related Art

A line printer (i.e., an image-forming apparatus) is known as a printer employing an electrophotographic method. The line printer has a structure in which a charger, a line-shaped printer head (i.e., a line head), a developing device, a transfer device, etc., are arranged closely to each other on the circumferential surface of a photosensitive drum used as a part to be exposed. In the line printer, an exposure spot that is turned into an electrostatic latent image is formed on the circumferential surface of the photosensitive drum electrostatically charged by the charger while exposing the photosensitive drum through a selective light-emitting operation of light emitting devices disposed on the printer head. The latent image is then developed with a toner supplied from the developing device, and a resulting toner image is transferred to a sheet of paper by the transfer device.

An image-forming apparatus in which a light-emitting device array that has organic electroluminescence devices (organic EL devices) serving as light-emitting devices is used as a printer head is known as the thus structured line printer (see Japanese Unexamined Patent Application, First Publication No. 2005-119104, for example).

In the line head disclosed in JP 2005-119104, relatively expanded light is projected from the organic EL devices onto a photosensitive drum, and hence the light becomes relatively low in brightness (i.e., in intensity), thus making it difficult to sufficiently expose the photosensitive drum. For example, a possible method for obtaining point-like light having high brightness is to pass a large amount of electric current through the small organic EL devices. However, according to this method, high heat is generated in the organic EL devices in accordance with the amount of the electric current, and deteriorates the organic EL devices used as light emitting devices, thus shortening the life of each of the organic EL devices.

SUMMARY

An advantage of some aspects of the invention is to provide a line head capable of lengthening the life of each organic EL device serving as a light emitting device and capable of having high brightness (i.e., high light intensity), and provide an image-forming apparatus including the line head.

According to a first aspect of the invention, there is provided a line head including: a first substrate having a plurality of organic electroluminescent devices; a bonding layer disposed on the first substrate and having optical transparency; a second substrate bonded to the first substrate with the bonding layer therebetween and having a reflective film that covers at least a part of the bonding layer; and a plurality of exit portions respectively from which light that has passed through the bonding layer is exited, the light emitted from the organic electroluminescent devices.

In the line head, light emitted from organic electroluminescent devices is reflected by the reflective film provided on the second substrate, is then guided through the optically transparent bonding layer, is then concentrated on the exit portion, and is passed out toward the outside. Since light obtained by concentrating the light emitted from organic electroluminescent devices is exit from each of the exit portions in this way, the light exited from each of the exit portion has high intensity (high brightness). If the size of the emitting area of the organic electroluminescent devices is enlarged without changing the size of the exit portion, the amount of light emitted from the organic electroluminescent devices is increased, and hence light having a higher intensity can be passed out from the exit portion. The photosensitive drum can be reliably exposed by using the line head capable of emitting light having high intensity. Since light having high intensity can be passed out without passing a large amount of electric current through such a small-sized organic electroluminescent device, the organic electroluminescent device is never deteriorated by heat. Thus, according to the line head, the life of the organic electroluminescent device can be lengthened, and light having high intensity can be passed out.

Preferably, in the line head, the second substrate faces an emission side of the first substrate. Accordingly, light emitted from the organic electroluminescent devices pass through the bonding layer, and is guided by the reflective film. Therefore, the light is never attenuated by a substrate through which light emitted from the organic electroluminescent device passes before being reflected unlike a case in which the reflection substrate is caused to adhere to the opposite side of the substrate. Therefore, light having high intensity can be obtained by efficiently passing out light from the exit portion.

Preferably in the line head, the light from each of the exit portions travels along a direction substantially parallel to an emission surface of the first substrate.

Preferably in the line head, the bonding layer has elongated areas. In this case, each of the exit portions may located at an end of each of the elongated areas.

Preferably in the line head, the reflective film has a plurality of concave surfaces facing the first substrate.

The line head may include a plurality of microlenses each of which corresponds to each of the exit portions. In this case, the line head may include a head base having the first substrate, the bonding layer, and the second substrate; and a microlens array substrate having the microlenses and bonded to the head base. In this line head, light exited from the exit portion can be concentrated by the microlens, and can be efficiently taken out toward the outside, and hence the intensity of the light can be heightened more.

According to a second aspect of the invention, there is provided an image-forming apparatus is characterized by including the line head mentioned above and a photosensitive drum exposed to the line head. In the image-forming apparatus, the line head having high light intensity is used as an exposure means, and hence the photosensitive drum can be reliably exposed to light, and a correct image can be formed.

DESCRIPTION OF EXEMPLARY EMBODIMENTS

Figure 1:
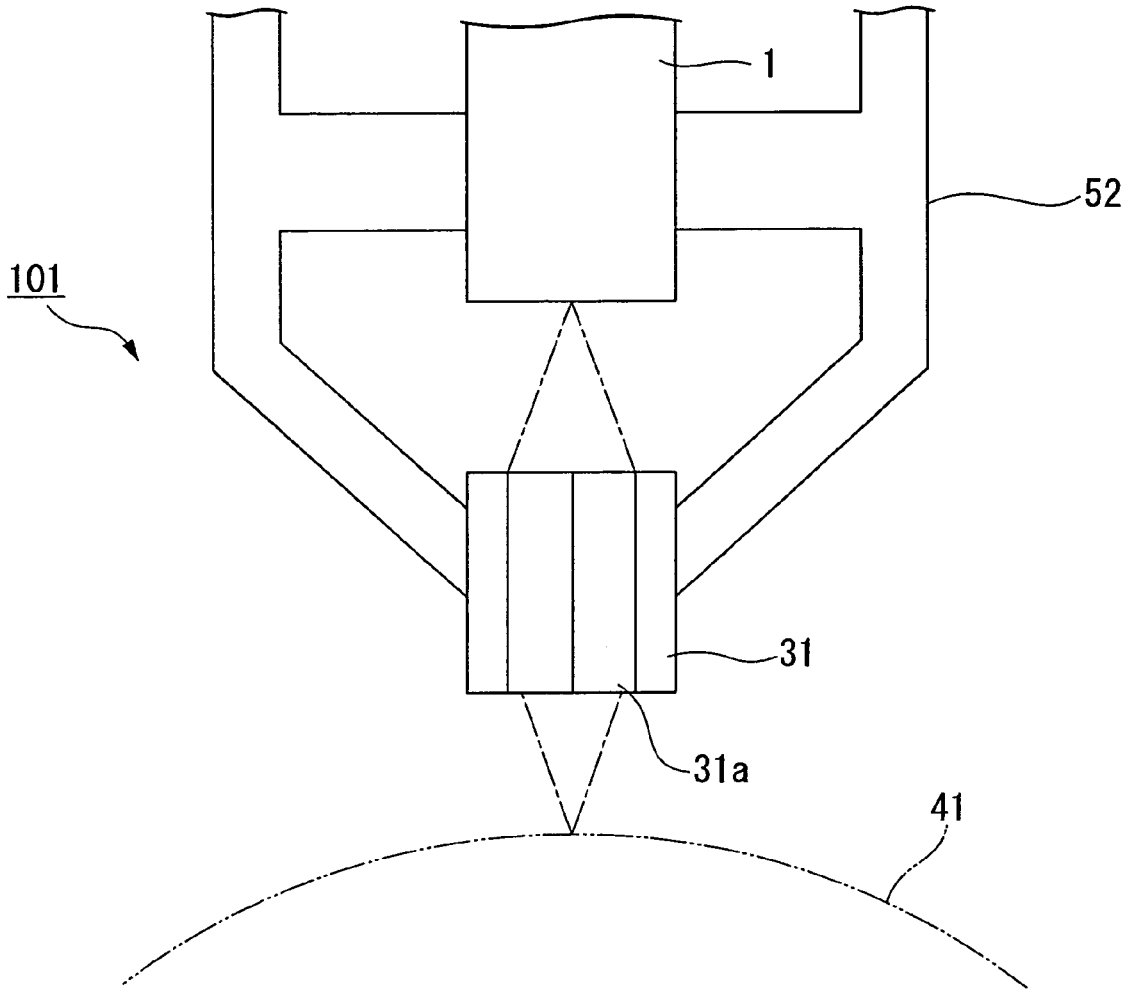
FIG. 1 is a cross-sectional side view of a line head module.

Embodiments of the present invention will be hereinafter described with reference to the attached drawings. In each drawing to which reference is made in the following description, the size and the like of each constituent are appropriately changed and displayed for better viewing of the drawing.

First Embodiment

A first embodiment of a line head will be first described. The line head is used as an exposure means of an image-forming apparatus described later. In more detail, the line head is used in the state of a line head module including the line head.

Line Head Module

First, a description will be given of a line head module used as an exposure means of an image-forming apparatus.

FIG. 1 is a sectional side view of the line head module. As shown in FIG. 1, a line head module 101 according to this embodiment includes a line head 1 that has a plurality of organic EL devices (electroluminescence devices) arranged in orderly rows, an SL array (Selfoc Lens Array) 31 that has a plurality of SL devices 31*a* arranged in orderly rows, and a head case 52 to which the line head 1 and the SL array 31 are fixed. The SL device 31*a* allows light emitted from the line head 1 to form an upright same-size image. In the line head module 101, light emitted from the organic EL devices of the line head 1 impinges on the SL devices 31*a* of the SL array 31, and forms an upright same-size image on the outer peripheral surface of a photosensitive drum 41 shown by the alternate long and two short dashes line in FIG. 1, thus performing exposure.

Line Head

Figure 2A:
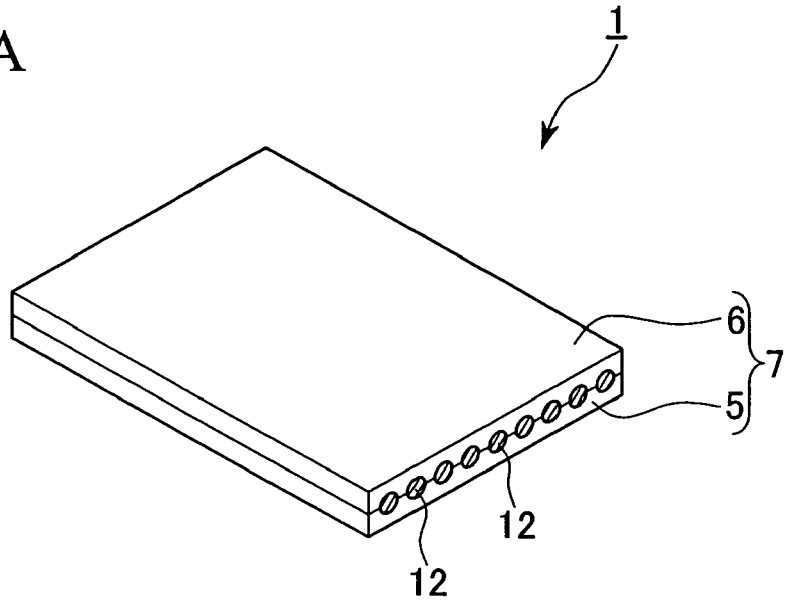
FIG. 2A is a perspective view of a line head.
Figure 2B:
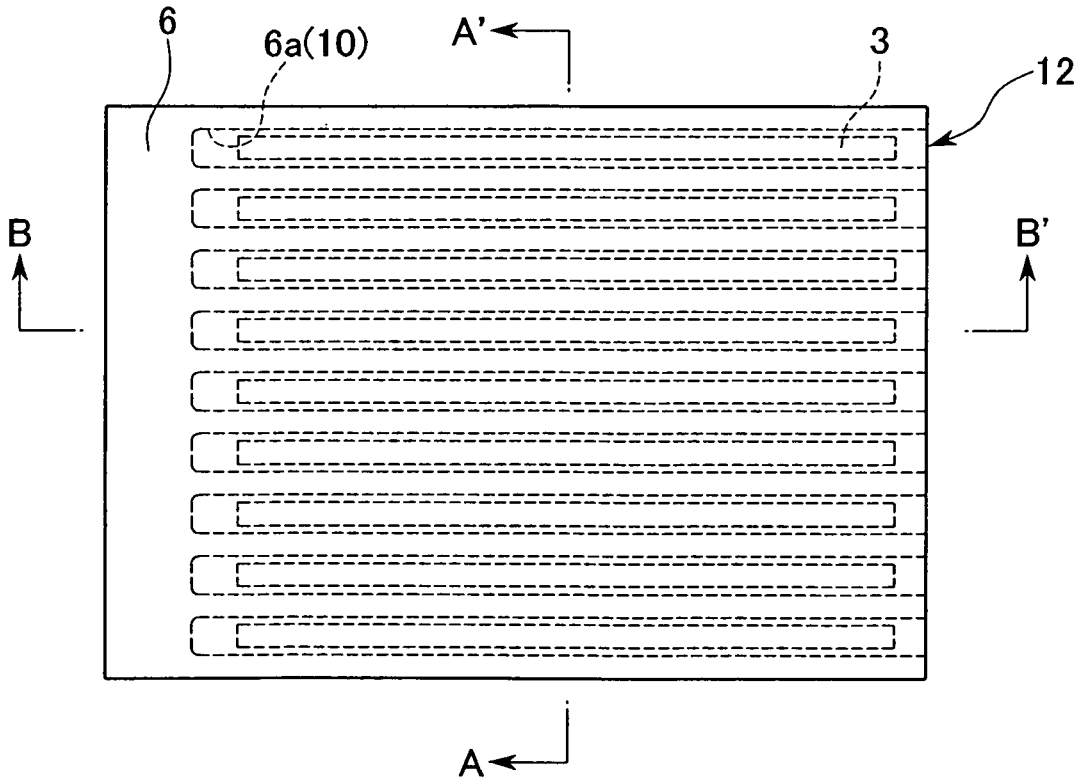
FIG. 2B is a side view of the line head.
Figure 3:
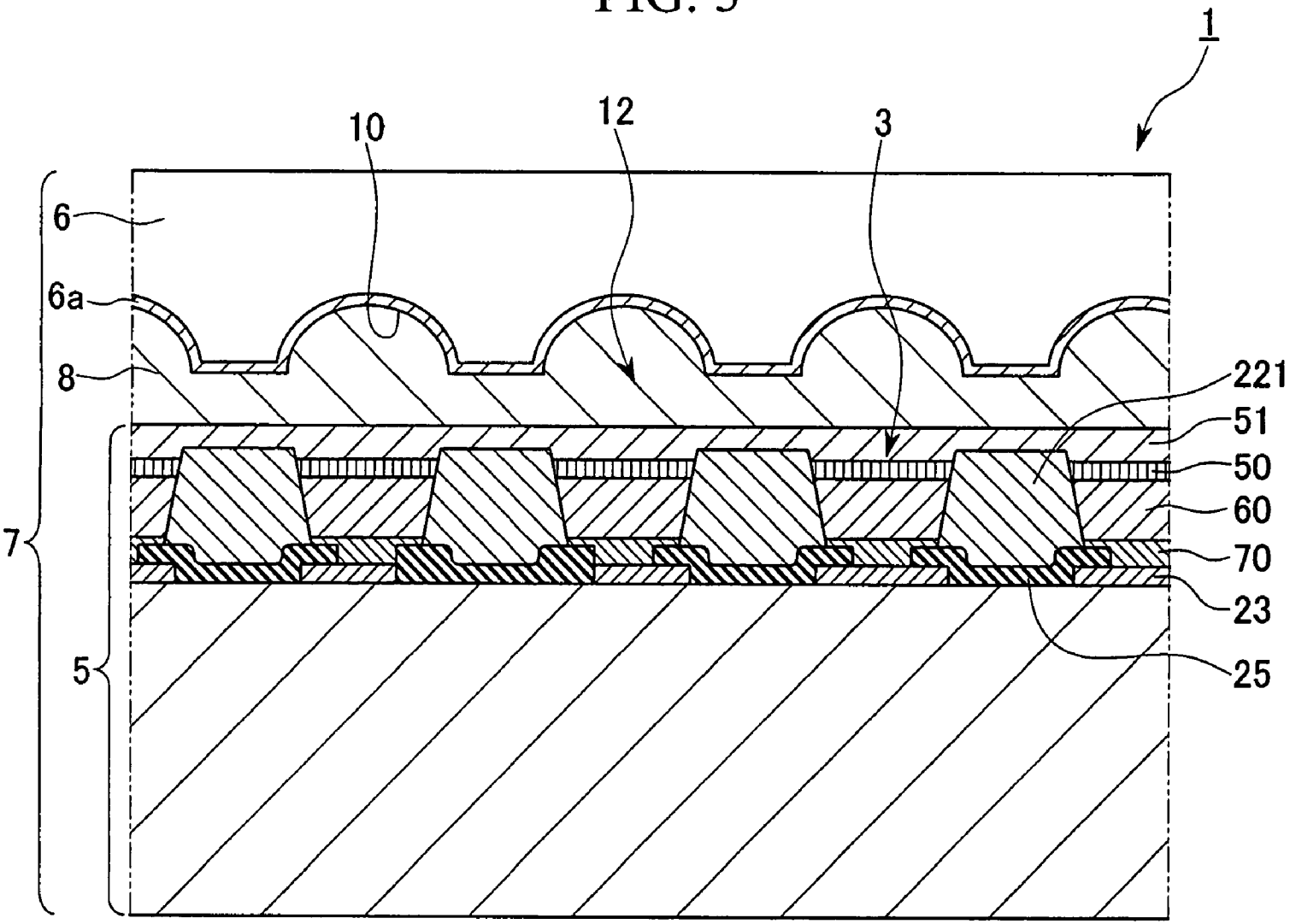
FIG. 3 is a sectional side view of the line head along the line A-A' of FIG. 2B.
Figure 4:
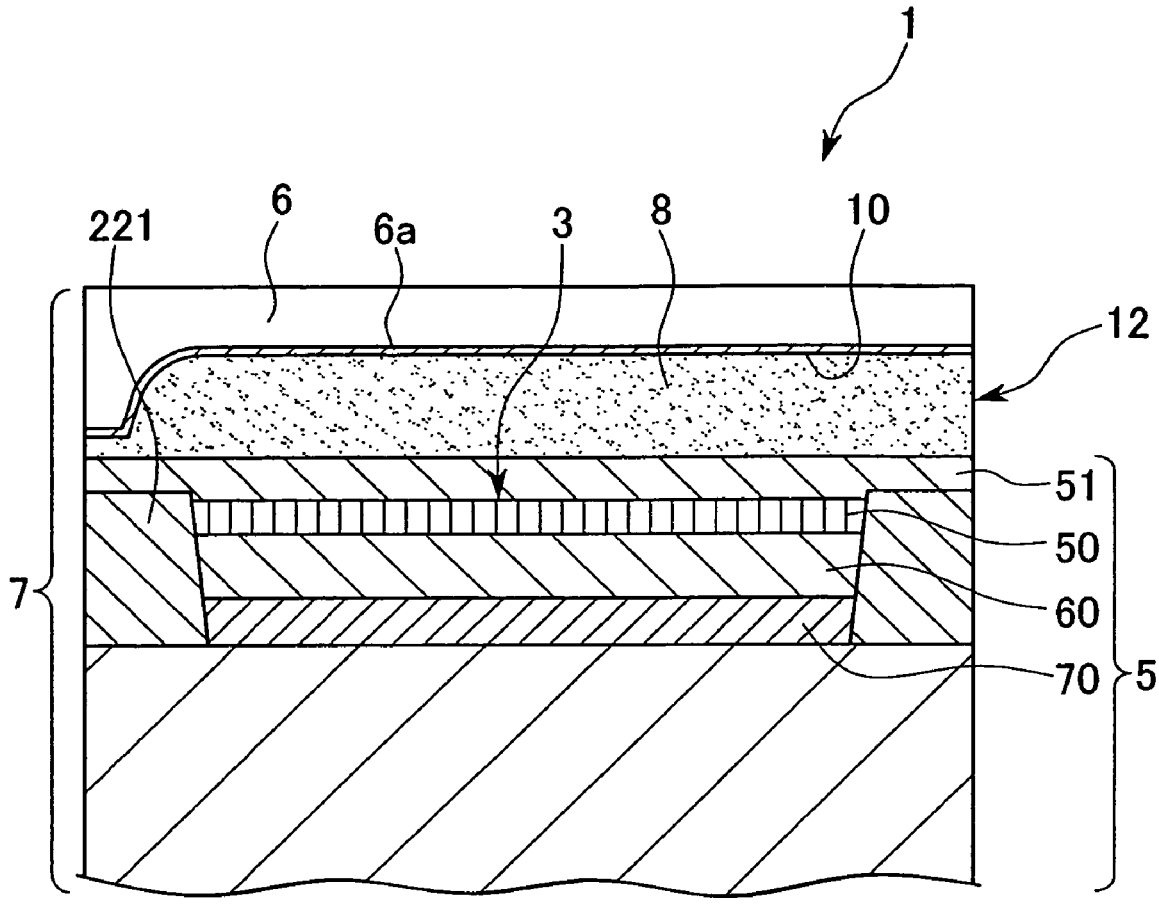
FIG. 4 is a sectional side view of the line head along the line B-B' of FIG. 2B.

Next, the line head 1 according to this embodiment will be described with reference to FIG. 2 to FIG. 4. FIG. 2A and FIG. 2B schematically show the line head 1, FIG. 2A is a perspective view thereof, and FIG. 2B is a side view thereof. FIG. 3 schematically shows the side section of the line head 1 along line A-A' of FIG. 2B. FIG. 4 schematically shows the side section of the line head 1 along line B-B' of FIG. 2B. In FIG. 3 and FIG. 4, driving device portions, such as TFT devices, formed on a device substrate 5 are not shown.

As shown in FIG. 2A and FIG. 2B, the line head 1 has a head base 7 consisting of a device substrate 5 on which the organic EL devices 3 are formed and a reflection substrate 6 that is caused to adhere to the device substrate 5 and that has a reflective film 6*a* serving to reflect light emitted from an organic EL devices 3. The device substrate 5 has the organic EL devices 3 and a substrate 5*a* made of Si as described later (see FIG. 6A and FIG. 6B). Driving devices are disposed on one surface of the substrate 5*a*. The organic EL device 3 is formed to be connected to the driving device.

As shown in FIG. 3, the reflection substrate 6 is caused to adhere to a surface 5 of the device substrate 5 from which the organic EL device 3 emits light via an bonding layer (adhesive layer)8 that has optical transparency and that is made of, for example, epoxy resin. The reflection substrate 6 faces an emission side of the device substrate 5. In more detail, since the organic EL device 3 according to this embodiment emits light according to a so-called top emission method, the bonding layer 8 and the reflection substrate 6 are provided on a surface of the substrate 5*a* on which the organic EL device 3 is disposed. An exit portion 12 that emits light emitted from each organic EL device 3 is provided on the end surface of a head base 7.

The organic EL device 3 has at least a light emitting layer 60 disposed between organic partitions 221 provided on the device substrate 5 and between a pair of electrodes consisting of an anode and a cathode. An electric current is supplied from the pair of electrodes to the light emitting layer 60, thereby allowing the organic EL device to emit light. In this embodiment, the organic EL device 3 is made up of a pixel electrode 23 that functions as the anode, an electron-hole transportation layer 70 that injects and transports electron holes sent from the pixel electrode 23, the light emitting layer 60 made of an organic EL material, and a cathode 50 that are arranged in this order.

A switching device (drive circuit), such as a thin-film transistor (TFT), is provided on the device substrate 5 as described later. The energization of the organic EL device 3 is controlled by the switching device.

As shown in FIG. 3 and FIG. 4, a plurality of groove parts each of which has a substantially hemispherically-shaped cross section so as to directly face each organic EL device 3 are formed on the inner surface side of the reflection substrate 6 (i.e., the bonding layer 8). The reflective film 6*a* that reflects light emitted from each organic EL device 3 is provided on the inner surface side of the reflection substrate 6 including these grooves.

The groove parts covered with the reflective film 6*a* are formed to be exposed to an end of the reflection substrate 6, and function as a reflecting portion 10 that reflects light emitted from each organic EL device 3.

In this embodiment, the reflecting portion 10 is a region in which the space between each organic EL device 3 and the reflective film 6*a* is filled with the bonding layer 8. The bonding layer 8 consists of a plurality of linear layers (elongated areas, lined areas) 8. The reflective film 6*a* faces the device substrate 5, and has a plurality of concave curved surfaces with which each bonding layer 8 is covered. The light of each organic EL device 3 reflected by the reflective film 6*a* is reflected by the reflecting portion 10. The reflecting portion 10 functions as a waveguide that guides the light to the exit portion 12 described later.

The light of each organic EL device 3 reflected by the reflective film 6*a* is guided through the bonding layer 8 (the reflecting portion 10) shown in FIG. 4, and is condensed on the end surface side of the head base 7. The exit portion 12 that emits the light of the organic EL devices 3 reflected by the reflective film 6*a* is provided on the end surface of the head base 7. The exit portion 12 is located at a place that is not covered with the reflective film 6*a* in the bonding layer 8. The area of the exit portion 12 is smaller than an area in which the organic EL devices 3 emit light, i.e., than the area of the light emitting layer 60. The exit portion 12 has its surface ground through a production process described later, and hence light exited from the exit portion 12 is prevented from being diffused.

In the line head 1 according to this embodiment, light emitted from each organic EL device 3 is reflected by the reflective film 6*a* provided on the reflection substrate 6, is then guided through the bonding layer 8 that is optically transparent, is then condensed on the exit portion 12 provided on the end surface of the head base 7, and is passed out toward the outside. Light emitted from the organic EL devices 3 is exited from the exit portion 12 in a direction substantially parallel to the plane (emission surface) on which the organic EL devices 3 of the device substrate 5 are formed (i.e., in a direction substantially parallel to a plane that includes the array direction of the organic EL devices 3).

According to the thus structured line head 1 in this embodiment, light having high intensity (high brightness) can be passed out by guiding the light emitted from the organic EL devices 3 to the exit portion 12 provided on the end surface side of the head base 7 and by condensing the light.

In this embodiment, the present invention is applied to the top emission type organic EL device 3. Instead, the present invention may be applied to, for example, a bottom emission type organic EL device 3 by allowing a reflection substrate to adhere to the side of the substrate 5*a* on which the organic EL devices 3 are not provided, with the bonding layer 8 therebetween. Preferably, in this case, the bonding layer 8 is thinned. If so, the space between the organic EL device 3 and the reflective film 6*a* is made small, and light emitted from the organic EL devices 3 can be efficiently passed out from the exit portion 12.

SL Array

Figure 5:
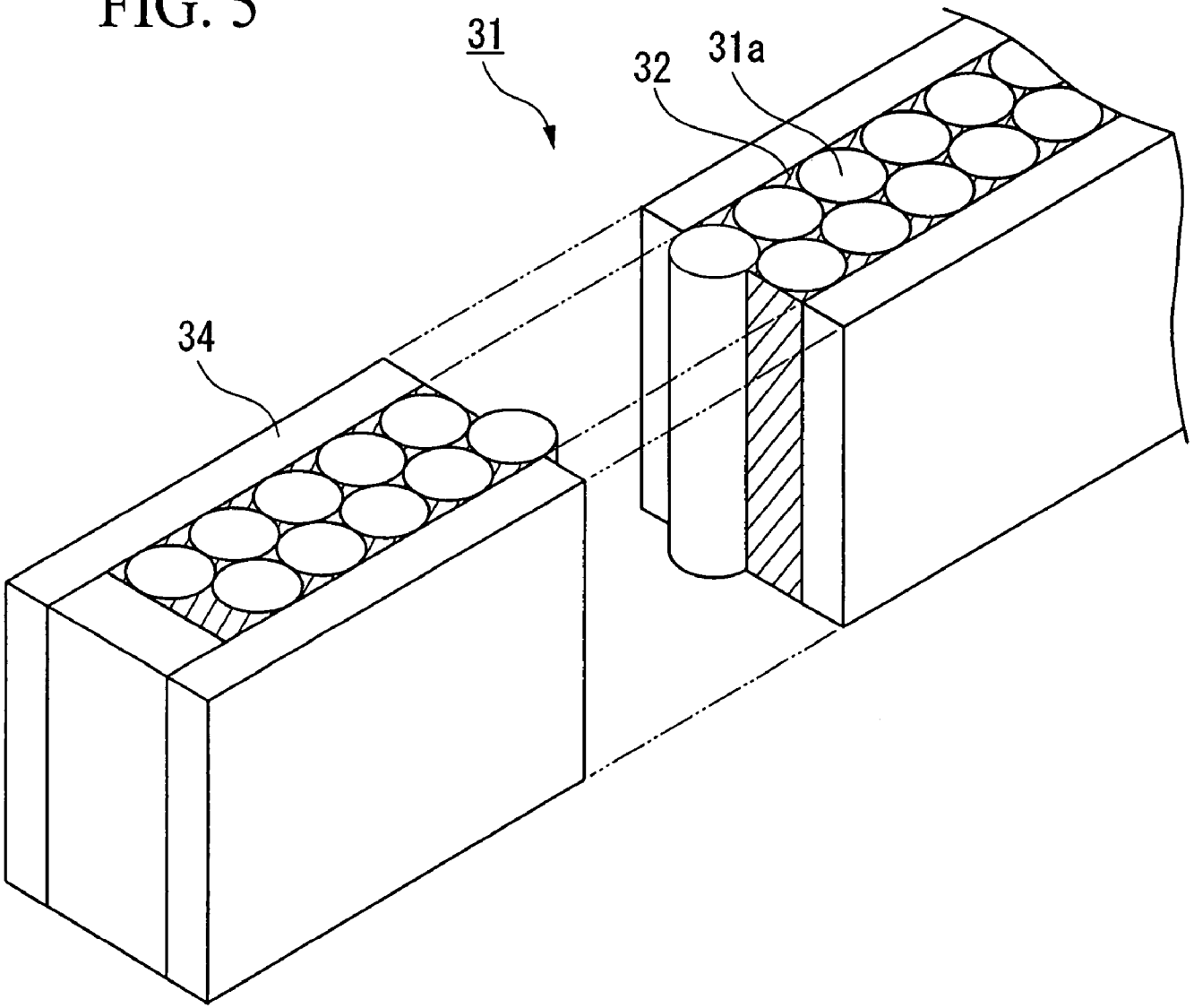
FIG. 5 is a perspective view of a SL array.

FIG. 5 is a perspective view of an SL array 31. The SL array 31 has a structure in which SL devices 31*a* produced by Nippon Sheet Glass Co., Ltd. are arranged. The SL devices 31*a* are shaped like a fiber, and have a diameter of about 0.28 mm. The SL devices 31*a* are arranged in a zigzag manner, and the space between the SL devices 31*a* is filled with a black silicone resin 32. The SL array 31 additionally has a frame 34 disposed around the SL devices 31*a*.

The SL devices 31*a* have refractive-index distribution on a parabola from their center to their periphery. Therefore, light entering to the SL device 31*a* travels through the SL device 31*a* while meandering at a constant frequency. An upright same-size image can be formed by adjusting the length of the SL device 31*a*. Images formed by the adjoining SL devices 31*a* can be superimposed on each other by arranging the SL devices 31*a* capable of forming such an upright same-size image in orderly rows, and hence a wide-ranging image can be obtained. Therefore, the SL array of FIG. 5 can allow light emitted from the whole of the line head 1 to form an image with high accuracy.

Organic EL Device and Driving Device

Figure 6A:
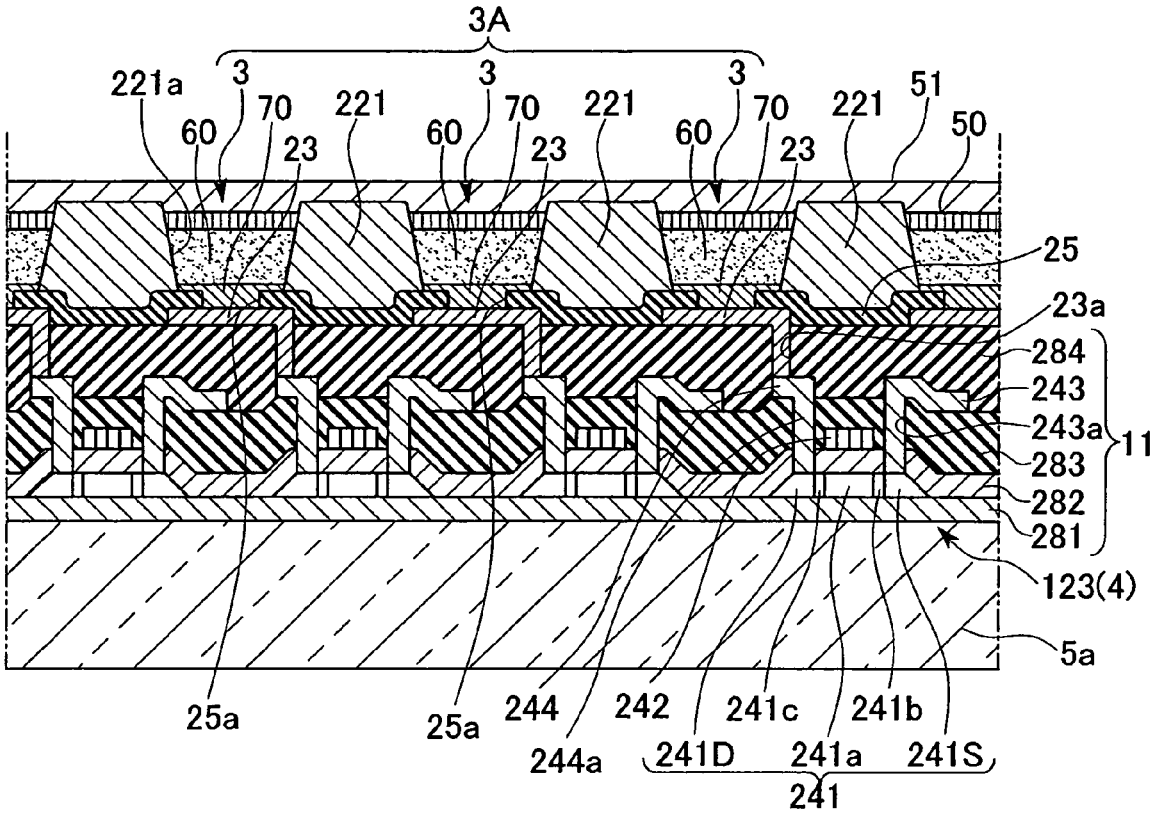
FIG. 6A and FIG. 6B show a detailed structure of an organic EL device and a detailed structure of a driving device, respectively.
Figure 6B:
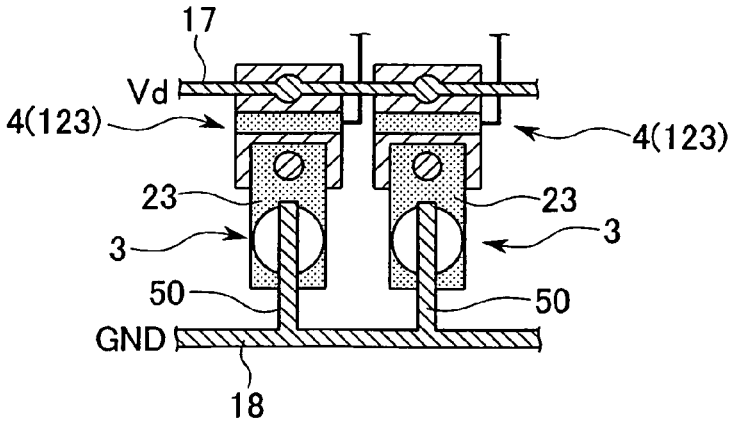

Next, a description will be given of detailed structures of the organic EL device 3, the driving device, etc., of the line head 1 with reference to FIG. 6A and FIG. 6B. FIG. 6A shows the detailed structure of the organic EL device 3 provided on the device substrate 5 that is a constituent of the line head 1. FIG. 6B shows the detailed structure of the driving device.

Since the organic EL device 3 according to this embodiment is the so-called top emission type as described above, emission light is passed out from the side of a sealing layer 51 of the device substrate 5. Although either a transparent substrate or an opaque substrate can be used as the substrate 5*a* that is a constituent of the device substrate 5, an opaque substrate is used in this embodiment.

The opaque substrate can be made of a thermosetting resin or a thermoplastic resin, as well as ceramics, such as alumina, and a metal sheet, such as a sheet of stainless steel, subjected to insulation processing, such as surface oxidation.

If the organic EL device 3 is the bottom emission type, light passes through the substrate 5*a*, and is then emitted therefrom. Therefore, for example, glass, quartz, resin, (plastic, plastic film), etc., can be mentioned as a material forming the substrate 5*a* that is transparent. Especially, a glass substrate is used as a desirable one.

A circuit portion 11 including a driving TFT 123 (a driving device 4) that is connected to the pixel electrode 23 is formed on the substrate 5*a*, and the organic EL device 3 is placed on the circuit portion 11. The organic EL device 3 is made up of the pixel electrode 23 that functions as an anode, an electron-hole transportation layer 70 that injects/transports the electron hole obtained from the pixel electrode 23, the light emitting layer 60 made of an organic EL material, and a cathode 50, which are arranged in this order. The organic EL device 3 is formed in an area defined by an organic partition 221.

FIG. 6B is a schematic view showing the organic EL device 3 and the driving TFT 123 (the driving device 4) corresponding to FIG. 2A. In FIG. 6B, a power wire 17 is connected to the source/drain electrodes of the driving device 4, and a power wire 18 is connected to the cathode 50 of the organic EL device 3.

The thus structured organic EL device 3 emits light, as shown in FIG. 6A, by combining an electron hole injected from the electron-hole transportation layer 70 and an electron obtained from the cathode 50 together in the light emitting layer 60.

In this embodiment, an inorganic partition 25 made of a lyophilic insulating material, such as $SiO_2$, is formed on the pixel electrode 23, and has an opening 25*a*.

The inorganic partition 25 is made of such an insulating material, and hence, in a functional layer a part of which is located in the opening 25*a*, an electric current does not flow through an area blocked by the inorganic partition 25, as described later. Therefore, a region from which light is emitted, i.e., a light emitting area is determined by the opening 25*a* of the inorganic partition 25.

Especially in the bottom emission type, the pixel electrode 23 is made of a transparent conductive material. In more detail, ITO (indium tin oxide) is used as its desirable material. Since the organic EL device 3 is the top emission type in this embodiment as mentioned above, the pixel electrode 23 has a structure in which a transparent electrode made of a transparent conductive material, such as ITO, having a relatively high work function is placed on a metal film having high reflectivity, such as an Ag film or an Al film.

Preferably, a dispersion liquid especially of 3,4-polyethylene dioxythiophene/polystyrene sulfonate (PEDOT/PSS) is used as a material for forming the electron-hole transportation layer 70. In more detail, a dispersion liquid produced in such a way that 3,4-polyethylene dioxythiophene is dispersed into polystyrene sulfonate serving as a dispersion medium, and is further dispersed into water is used as a desirable material for the electron-hole transportation layer 70.

Without being limited to the aforementioned material, various materials can be used for forming the electron-hole transportation layer 70. For example, use can be made of a dispersion liquid in which polystyrene, polypyrrole, polyaniline, polyacetylene, or any of the derivatives of these compounds is dispersed into an appropriate dispersion medium, such as polystyrene sulfonate mentioned above.

A known light-emitting material capable of emitting fluorescence or phosphorescence is used for forming the light emitting layer 60. In this embodiment, for example, a light emitting layer whose emitted-light wavelength range corresponds to red is employed. Of course, a light emitting layer whose emitted-light wavelength range corresponds to green or blue may be employed.

Specifically, (poly) fluorene derivatives (PF), (poly) paraphenylene vinylene derivatives (PPV), polyphenylene derivatives (PP), polyparaphenylene derivatives (PPP), polyvinyl carbazole (PVK), polythiophene derivatives, or polysilane-based compounds such as polymethylphenylsilane (PMPS) can be preferably used as a material for forming the light emitting layer 60. To form the light emitting layer 60, these polymeric materials may be doped with polymer-based materials, such as perylene-based coloring matter, coumarin-based coloring matter, or rhodamine-based coloring matter, or may be doped with low-molecular weight materials, such as rubrene, perylene, 9,10-diphenylanthracene, tetraphenylbutadiene, nile red, coumarin 6, or quinacridone.

The cathode 50 is formed in such a way as to cover the light emitting layer 60. Since the line head 1 according to this embodiment is the top emission type as mentioned above, the material of the cathode 50 is required to be optically transparent, and hence a transparent conductive material is used to form the cathode 50. Preferably, ITO is used as the transparent conductive material. Instead of ITO, use can be made of, for example, an indium oxide/zinc oxide-based amorphous transparent conductive film (Indium Zinc Oxide: IZO (registered trademark))(manufactured by Idemitsu Kosan Co., Ltd.). In this embodiment, ITO is used. For example, use is made of an electrode having a layered structure in which a Ca layer is formed to have a thickness of about 5 nm, and then an ITO film having a thickness of about 200 nm is formed on the Ca layer. Accordingly, emission light can be passed out from the side of the cathode 50.

A sealing layer 51 is formed on the cathode 50 in such a way as to cover the cathode 50 and the upper surface of the organic partition 221. The sealing layer 51 is made of a translucent resin, such as acrylic resin or epoxy resin. In this case, for passivation, it is recommended to form a film made of SiN or SiON on the cathode 50.

The sealing layer 51 prevents oxygen or water from infiltrating therethrough. Therefore, the sealing layer 51 prevents oxygen or water from infiltrating into the organic EL device 3 including the cathode 50 and the light emitting layer 60, and hence the organic EL device 3 can be prevented from being deteriorated by oxygen or water.

The sealing layer 51 may have a structure in which, for example, inorganic films and adherent organic films, such as synthetic resins, are alternately stacked on each other. The layered structure formed by the inorganic films and the organic films can prevent the occurrence of cracks. Additionally, the sealing layer 51 may have a multilayered structure formed by many inorganic films. In this case, for example, a multilayered structure formed by layers made of one kind of material, such as silicon oxynitride (SiON), may be provided, or, alternatively, a multilayered structure formed by layers made of different kinds of materials, such as silicon nitride and silicon dioxide, may be provided. The multilayered structure formed by inorganic films is advantageous for the improvement of sealability with respect to the organic EL device 3.

The circuit portion 11 is provided under the organic EL device 3 as described above. The circuit portion 11 is formed on the substrate 5*a*. In more detail, a foundation protecting layer 281 that is composed chiefly of $SiO_2$ and that serves as a foundation is formed on the surface of the substrate 5*a*. A silicon layer 241 is formed on the foundation protecting layer 281. A gate insulating layer 282 composed chiefly of $SiO_2$ and/or SiN is formed on the surface of the silicon layer 241.

A part of the silicon layer 241 that is overlapped with a gate electrode 242 with the gate insulating layer 282 placed between the silicon layer 241 and the gate electrode 242 is a channel region 241*a*. The gate electrode 242 is a part of a scanning line not shown. On the other hand, a first interlayer insulating layer 283 composed chiefly of $SiO_2$ is formed on the surface of the gate insulating layer 282 with which the silicon layer 241 is covered and on which the gate electrode 242 is formed.

A lightly-doped source region 241*b* and a heavily-doped source region 241S are provided on the source side of the channel region 241*a* of the silicon layer 241. On the other hand, a lightly-doped drain region 241*c* and a heavily-doped drain region 241*d* are provided on the drain side of the channel region 241*a*. Accordingly, a so-called LDD (Light Doped Drain) structure is formed. The heavily-doped source region 241S is connected to a source electrode 243 via a contact hole 243*a* formed from the gate insulating layer 282 to the first interlayer insulating layer 283. The source electrode 243 is formed as a part of a power wire (not shown). On the other hand, the heavily-doped drain region 241D is connected to a drain electrode 244 located at the same layer as the source electrode 243 via a contact hole 244*a* formed from the gate insulating layer 282 and the first interlayer insulating layer 283.

A flattening film 284 composed chiefly of, for example, acrylic resin is formed on the upper layer of the first interlayer insulating layer 283 where the source electrode 243 and the drain electrode 244 are formed. The flattening film 284 is made of, for example, an acrylic-based or polyimide-based heat-resistant insulating resin, and is a well-known film formed to remove the surface unevenness caused by the driving TFT 123 (the driving device 4), the source electrode 243, and/or the drain electrode 244.

The pixel electrode 23 made of, for example, ITO is formed on the surface of the flattening film 284, and is connected to the drain electrode 244 via the contact hole 23*a* formed in the flattening film 284. In other words, the pixel electrode 23 is connected to the heavily-doped drain region 241D of the silicon layer 241 via the drain electrode 244.

The pixel electrode 23 and the inorganic partition 25 mentioned above are formed on the surface of the flattening film 284. The organic partition 221 is formed on the inorganic partition 25. The region defined inside an opening 25*a* formed in the inorganic partition 25 and inside the opening 221*a* formed in the organic partition 221 on the pixel electrode 23 is a so-called pixel region. In the pixel region on the pixel electrode 23, the electron-hole transportation layer 70 and the light emitting layer 60 are stacked up in this order from the side of the pixel electrode 23. Thus, the organic EL device 3 is formed.

Method for Producing the Line Head

Next, a method for producing the line head 1 will be described. The wafer-shaped substrate 5*a* is used in this embodiment. The line-head producing process includes a step of forming the organic EL device 3 on the substrate 5*a* to form the device substrate 5, a step of causing the device substrate 5 to adhere to the reflection substrate 6 with the bonding layer 8 therebetween, and a step of cutting the resulting piece through a dicing operation.

Figure 7A:
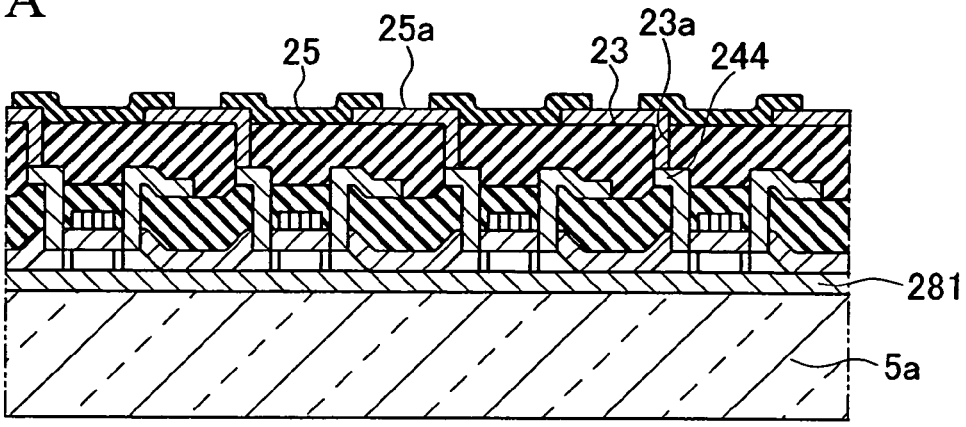
FIG. 7A, FIG. 7B, and FIG. 7C are explanatory drawings for explaining line-head producing steps.

First, as shown in FIG. 7A, the foundation protecting layer 281 is formed on the surface of the substrate 5*a* that is a constituent of the device substrate 5. Thereafter, a polysilicon layer or the like is formed on the foundation protecting layer 281, and the circuit portion 11 is formed from the polysilicon layer or the like. Thereafter, a metal film, such as an Ag film or an Al film having high reflectivity, is stacked on the ITO film in such a way as to cover the whole surface of the device substrate 5. This conductive film is subjected to patterning, thus forming the pixel electrode 23 electrically connected to the drain electrode 244 via the contact hole 23*a* of the flattening film 284.

Thereafter, a partition layer (not shown) is formed by forming a film made of an insulating material, such as $SiO_2$, on the pixel electrode 23 and on the flattening film 284 according to, for example, a CVD method. Thereafter, the partition layer is subjected to patterning by employing a known photolithography technique or a known etching technique. As a result, the inorganic partition 25 having the openings 25*a* each of which corresponds to the pixel region of the organic EL device is formed as shown in FIG. 7A.

Figure 7B:
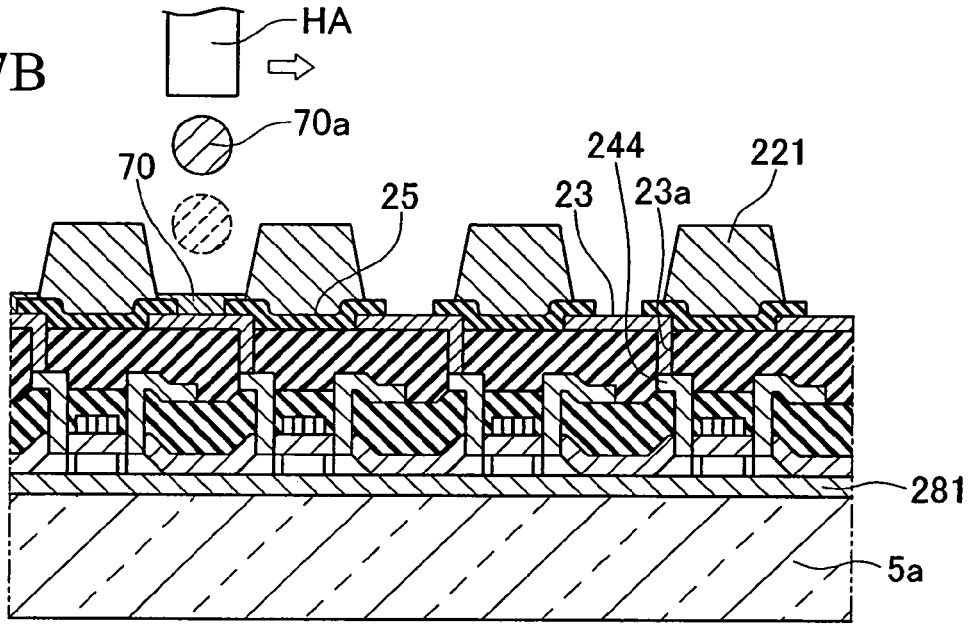

Thereafter, as shown in FIG. 7B, the organic partition 221 is made of resin or the like at a predetermined location of the inorganic partition 25, i.e., at a location surrounding the pixel region. As described later, this organic partition 221 is to divide the area in which the organic EL device 3 is formed.

Thereafter, regions exhibiting lyophilic properties and regions exhibiting lyophobic properties (i.e., liquid-repellent properties) are formed on the surface of the device substrate 5. In this embodiment, each region is formed according to plasma processing. In more detail, the plasma processing includes a preheating step, a lyophilic step, a lyophobic step, and a cooling step. The lyophilic step is performed so that the surface of the organic partition 221, the wall surface of the opening 221*a*, the electrode plane of the pixel electrode 23, and the surface of the inorganic partition 25 are treated to have lyophilic properties. The lyophobic step is performed so that the upper surface of the organic partition 221 and the wall surface of the opening 221*a* are treated to have lyophobic properties.

In more detail, in the plasma processing, the base material (i.e., the device substrate 5 including the partition and other elements) is heated to a predetermined temperature (e.g., about 70° C. to 80° C.), and then plasma processing ($O_2$ plasma processing) in which oxygen is used as a reactive gas is performed under atmospheric pressure at the lyophilic step. Thereafter, plasma processing ($CF_4$ plasma processing) in which tetrafluoromethane is used as a reactive gas is performed under atmospheric pressure at the lyophobic step, and then the base material heated through the plasma processing is cooled to room temperature. Accordingly, lyophilic properties and lyophobic properties are given to predetermined parts of the substrate.

At the lyophobic step, the influence of the $CF_4$ plasma processing is slightly exerted on the electrode plane of the pixel electrode 23 and the inorganic partition 25. However, ITO of which the pixel electrode 23 is made and $SiO_2$ or $TiO_2$ of which the inorganic partition 25 is made are small in affinity for fluorine. Therefore, the hydroxyl group provided at the lyophilic step is never replaced by the fluorine group, and each surface can be kept lyophilic.

Thereafter, the electron-hole transportation layer 70 is formed in an area surrounded by the organic partition 221. Preferably, an ink jet method is employed to form the electron-hole transportation layer 70. In detail, according to the ink jet method, a material 70*a* to form the electron-hole transportation layer 70 is selectively disposed and applied onto the electrode plane. Thereafter, the layer material 70*a* is subjected to dry treatment and heat treatment. As a result, the electron-hole transportation layer 70 is formed on the pixel electrode 23. For example, a solution in which PEDOT:PSS mentioned above is dissolved in a polar solvent, such as isopropyl alcohol, is used as the material to form the electron-hole transportation layer 70.

In the process for forming the electron-hole transportation layer 70 employing the ink jet method, an ink jet head HA is first filled with the layer material 70*a* to form the electron-hole transportation layer 70. Thereafter, as shown in FIG. 7B, liquid drops in which the liquid amount per drop is controlled are discharged to the electrode plane located in the opening 25*a* of the inorganic partition 25 from a jet nozzle of the ink jet head HA. At this time, the jet nozzle of the ink jet head HA is disposed to face the electrode plane, and the ink jet head and the base material (the device substrate 5) are relativity moved if necessary. Thereafter, the liquid drops discharged therefrom are subjected to dry treatment, and dispersion mediums and solvents contained in the layer material 70*a* are evaporated, thus forming the electron-hole transportation layer 70.

Preferably, the ink jet head HA is a liquid drop jet head using a method in which liquid drops are discharged from the nozzle by changing the pressure of the inside of a liquid chamber by use of a piezoelectric element that generates mechanical vibrations by being energized. Alternatively, it is permissible to employ a liquid drop jet head using a method in which liquid drops are discharged from the nozzle by partially heating the inside of the liquid chamber by use of a heating element so as to generate air bubbles. Additionally, it is permissible to employ an electrification control type or a pressure vibration type continuous method, an electrostatic suction method, or a method in which an element is heated by being irradiated with electromagnetic waves, such as a laser beam, and liquids are discharged by using an action caused by the resulting heat.

The liquid drops discharged from the jet nozzle are spread on the electrode plane that has undergone the lyophilic processing, are then caused to flow into the opening 25*a* of the inorganic partition 25, and are concentrated inside the opening 25*a*. The liquid drops are repelled by the upper surface of the organic partition 221 that has undergone the lyophobic processing, and are never attracted thereto. In other words, even if the liquid drops are discharged so as not to coincide with a to-be-discharged target point so that some of the liquid drops fall on the surface of the organic partition 221, the upper surface of the organic partition 221 is never wetted, and the liquid drops repelled thereby are drawn into the opening 25*a* of the inorganic partition 25.

After the step of forming the electron-hole transportation layer, it is preferable to treat various materials and elements made of these materials under an inert gas atmosphere, such as a nitrogen atmosphere or an argon atmosphere, in order to protect the materials and the elements from oxidation and moisture absorption.

Figure 7C:
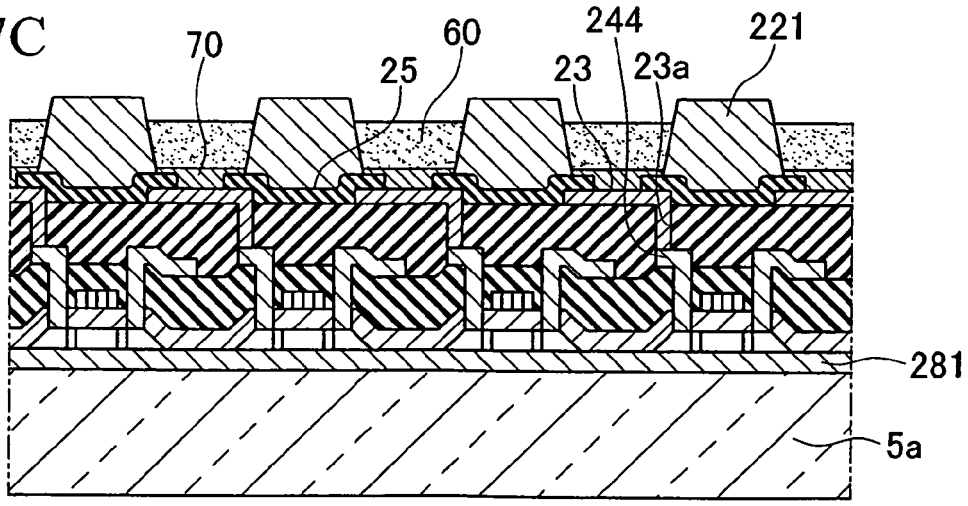

Thereafter, as shown in FIG. 7C, the light emitting layer 60 is formed in an area defined by the organic partition 221. At the light-emitting layer 60 forming step, the ink jet method mentioned above can be employed as a desirable method, at the step of forming the electron-hole transportation layer 70. In detail, a material to form the light emitting layer 60 is discharged onto the electron-hole transportation layer 70 according to the ink jet method. Thereafter, this material is subjected to dry treatment and heat treatment. As a result, the light emitting layer 60 is formed in the opening 221*a* of the organic partition 221 and in the pixel region.

Thereafter, the cathode 50 is formed on the light emitting layer 60. It is general to employ a layered structure consisting of an electron injecting layer and a conductive layer as the cathode 50, in order to allow the organic EL device 3 to efficiently emit light. In this embodiment, the cathode 50 is formed with a layered film made of Ca and ITO; as described above.

In this embodiment, the device substrate 5 and a metal mask not shown are positionally adjusted, and the cathode 50 is formed according to the vapor deposition method or the sputtering method. Thus, the cathode 50 with which the light emitting layer 60 is selectively covered is formed. When the cathode 50 is formed, a material (ITO) may be provided on almost the whole surface of the substrate 5*a* including the part on the organic partition 221.

Thereafter, at the sealing step, the cathode 50 and the whole surface of the substrate 5*a* including the part on the organic partition 221 are covered with the sealing layer 51. The sealing layer 51 is applied onto the substrate 5*a* by use of, for example, a micro dispenser.

The device substrate 5 including the organic EL device 3 shown in FIG. 6A and FIG. 6B is produced through the aforementioned steps.

Figure 8A:
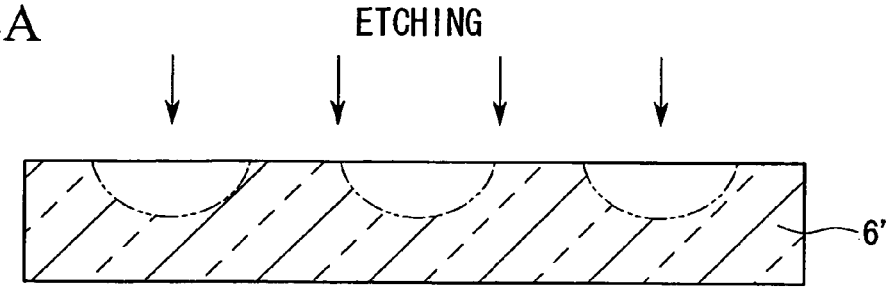
FIG. 8A, FIG. 8B, and FIG. 8C are explanatory drawings for explaining line-head production steps following the step of FIG. 7C.
Figure 8B:
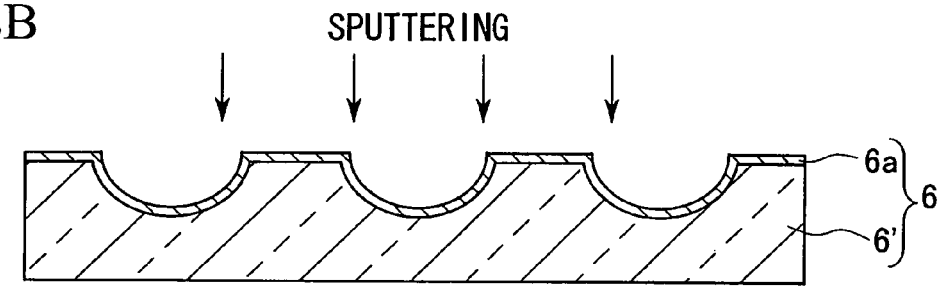

Referring now to FIG. 8A and FIG. 8B, a description will be given of a step of causing the reflection substrate 6 and the device substrate 5 to adhere to each other. FIG. 8A and FIG. 8B are process drawings based on a cross section along line B-B' of FIG. 2B.

First, a glass substrate 6' that serves as a precursor of the reflection substrate 6 used to adhere to the device substrate 5 is prepared as shown in FIG. 8A. The glass substrate 6' is equal in size to the wafer-shaped device substrate 5. A concave portion, which corresponds to the organic EL device 3 when planarly viewed as shown in FIG. 2A and FIG. 2B and whose cross section is semicircular, is formed by subjecting the glass substrate 6' to wet etching. Herein, the concave portion is turned into the reflecting portion 10 (see FIG. 3) that is a constituent of the exit portion 12 through the dicing step described later.

Thereafter, as shown in FIG. 8B, the reflective film 6*a* that reflects light emitted from the organic EL device 3 is formed on the front surface of the glass substrate side 6' where the concave portion is formed according to the sputtering method. The reflection substrate 6 provided with the reflective film 6*a* that reflects the light of the organic EL device 3 is formed in this way.

Figure 8C:
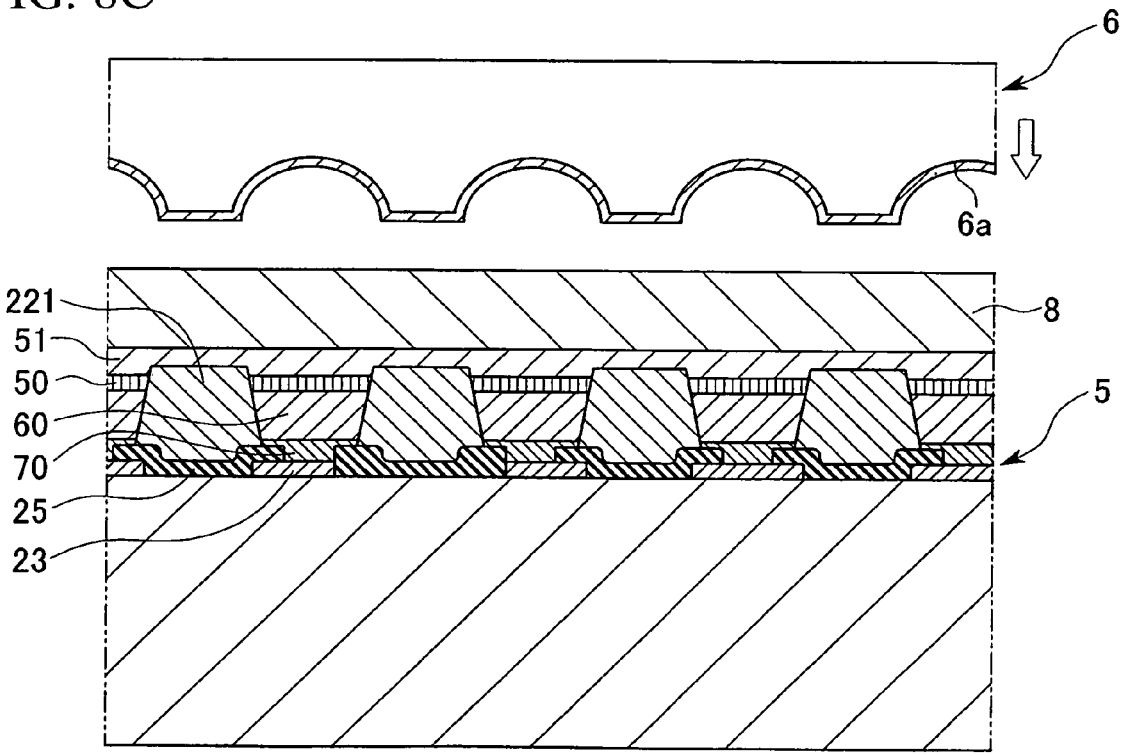

Thereafter, the device substrate 5 and the reflection substrate 6 are caused to adhere to each other with the bonding layer 8 that has optical transparency and that is placed between the device substrate 5 and the reflection substrate 6. First, for example, an epoxy resin that has optical transparency and that functions as a thermosetting adhesive is applied onto the surface of the device substrate 5 on the side of which the organic EL device 3 is provided according to screen printing or dispensing, as shown in FIG. 8C.

Figure 9A:
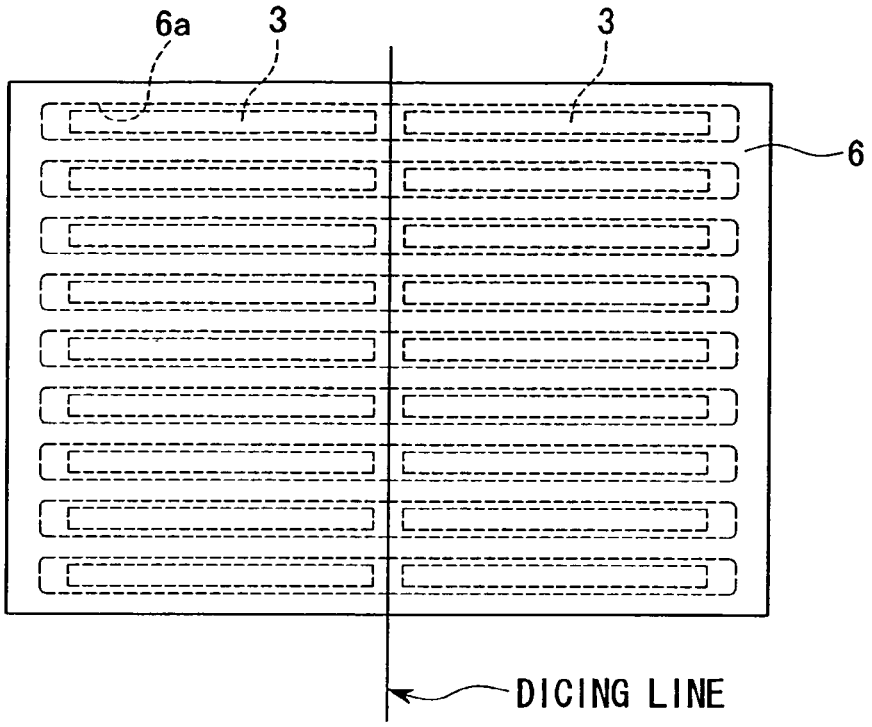
FIG. 9A and FIG. 9B are explanatory drawings for explaining line-head production steps following the step of FIG. 8C.

Thereafter, the device substrate 5 provided with the bonding layer 8 and the reflection substrate 6 are aligned, and are then caused to adhere to each other while being heated and pressed via the bonding layer 8. Thus, an adhesive body that serves as a precursor of the head base 7 shown in FIG. 9A is formed. In this embodiment, two organic EL devices 3 are provided in each concave portion formed in the reflection substrate 6 as shown in FIG. 9A that is a plan view.

Figure 9B:
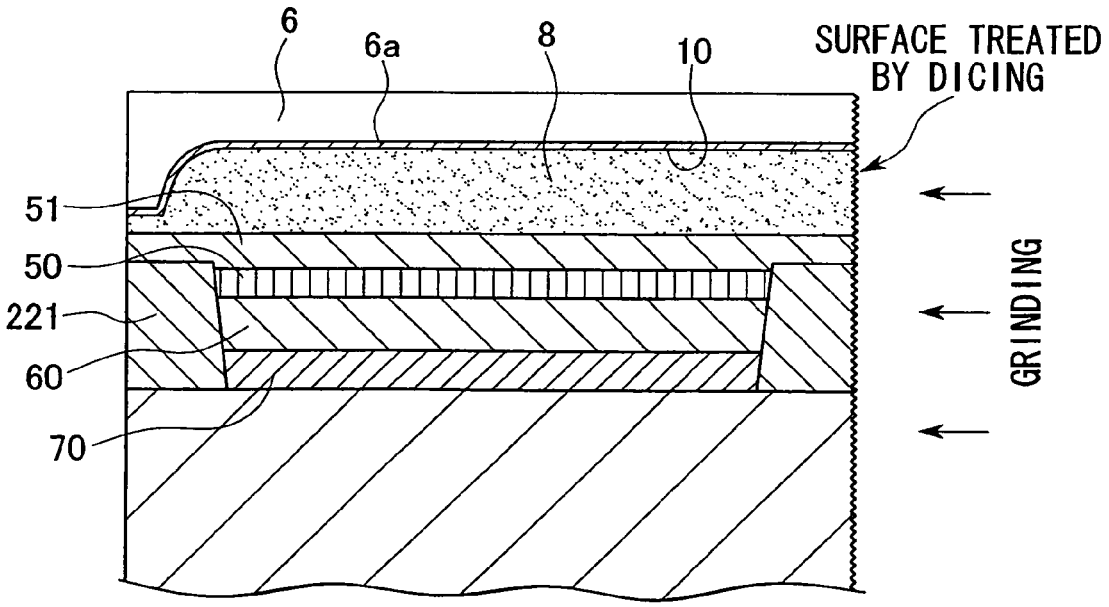

Thereafter, the adhesive body is divided into line heads by use of a dicing blade along a dicing line shown in FIG. 9B. As a result, the head base 7 made up of the device substrate 5 and the reflection substrate 6 that have adhered with the bonding layer 8 therebetween is formed as shown in FIG. 9B.

Since the concave portion formed in the reflection substrate 6 is cut at this time, the bonding layer 8 appears from the cut side on an end surface of the head base 7 that is a cut plane formed by dicing. As described above, the bonding layer 8 has optical transparency. Therefore, light emitted from the organic EL device 3 is reflected by the reflective film 6*a* of the reflection substrate 6, and then travels through the bonding layer 8. In other words, in the head base 7, an exposed part of the bonding layer 8 in the end surface of the head base 7 is a constituent of the exit portion 12. The reflecting portion 10 in which the space between each organic EL device 3 and the reflective film 6*a* is filled with the bonding layer 8 forms a waveguide that reflects the light of each organic EL device 3 by the reflective film 6*a* and that guides the light to the exit portion 12.

Incidentally, in the exit portion 12 of the head base, the surface thereof has been roughened by dicing. Therefore, the surface that has undergone the dicing processing is ground and flattened, and hence the light of the organic EL device 3 exited from the exit portion 12 can be prevented from being diffused. The line head 1 of this embodiment can be formed through the steps mentioned above.

In the surface of the head base 7 on the opposite side of the exit portion 12, there is a case in which part of the reflected light leaks out from the exposed part of the bonding layer 8. However, the amount of light leaking out therefrom is substantially negligibly smaller than in the exit portion 12. More preferably, the efficiency of passing out light is promoted by additionally forming the reflective film 6*a* on the surface on the opposite side of the exit portion 12 and by passing out the light of the organic EL device 3 only from the exit portion 12.

Next, a description will be given of a case in which light is emitted from each exit portion 12 of the line head 1. In the line head 1 according to this embodiment, each organic EL device 3 emits light via the circuit portion 11 including the switching device, such as TFT, as mentioned above. Light emitted from the organic EL device 3 is reflected by the reflective film 6*a*.

The reflecting portion 10 formed on the reflection substrate 6 functions as a waveguide that guides the reflected light of the organic EL device 3, and condenses light emitted from each organic EL device 3 on the corresponding exit portion 12. Therefore, light reflected by the reflective film 6*a* travels through the bonding layer 8 (the reflecting portion 10) toward the exit portion 12 that serves as a port from which light is passed out to the outside.

Thus, according to the line head 1 of this embodiment, light emitted from each organic EL device 3 is reflected by the reflective film 6*a* provided on the reflection substrate 6, is then guided through the optically transparent bonding layer 8 (the reflecting portion 10), is then condensed on the exit portion 12 provided on the end surface of the head base 7, and is passed out to the outside.

If the amount of light emitted from the organic EL device 3 is increased by enlarging the area of the organic EL device 3, the head base 7 structured as above is enlarged in the longitudinal direction. However, the size of the exit portion 12 and the pitch of each exit portion 12 are not changed. As a result, light having a higher intensity can be passed out from the exit portion 12 provided on the end surface of the head base 7.

Thus, the line head 1 of this embodiment condenses light emitted by the plane light emission from the organic EL device 3, and emits the light in the form of point-like light from the exit portion 12, and hence light having a high intensity can be passed out from the exit portion 12 toward the outside. Additionally, light having a high intensity can be passed out without increasing an electric current that is passed through the organic EL device, and hence the EL device can be prevented from being deteriorated by heat.

In other words, in the line head 1, emitted light can have a high intensity, and the life of the organic EL device 3 can be lengthened. The line head module 101 provided with this line head 1 can project high-intensity light emitted from the line head 1 onto the photosensitive drum 41 via the SL array 31, thus making it possible to reliably expose the surface of the photosensitive drum 41.

Second Embodiment

Next, a second embodiment of the line head of the present invention will be described.

Figure 10A:
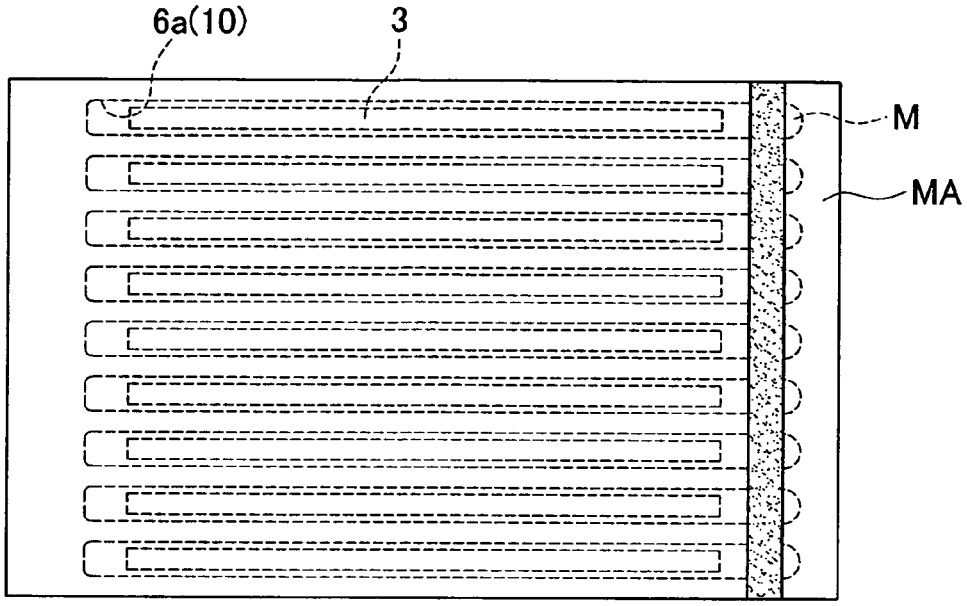
FIG. 10A and FIG. 10B are views showing a line head according to a second embodiment.
Figure 10B:
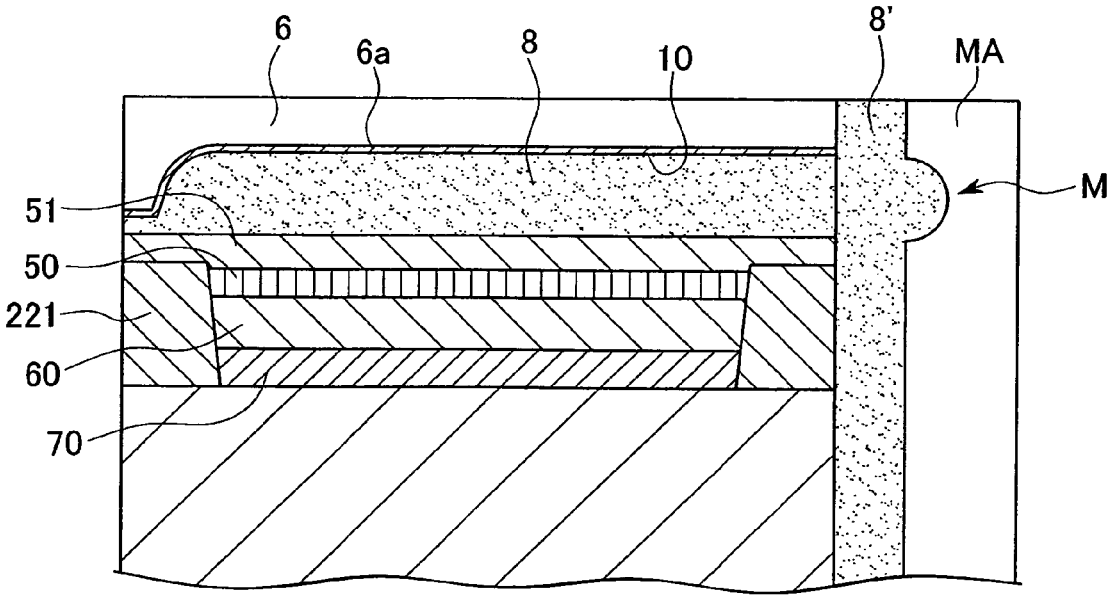

As shown in FIG. 10A and FIG. 10B, a line head 1' according to this embodiment includes a microlens array substrate MA that has a plurality of microlenses M on the side of the end surface of the head base 7. In this embodiment, the structure of the line head 1' excluding the microlens M is the same as that of the microlens M according to the first embodiment. In the following description, the same reference characters are given to the same structures as in the first embodiment, and a description of the same structures is omitted.

The microlens array substrate MA is formed with a glass substrate, and has a plurality of microlenses M each of which corresponds to each of the exit portions 12, as shown in FIG. 10A and FIG. 10B.

Each microlens M is aligned with each exit portion 12, and is caused to adhere to the head base 7 with an bonding layer 8' having optical transparency. The bonding layer 8' is made of the same material as the bonding layer 8 with which the device substrate 5 and the reflection substrate 6 are caused to adhere to each other.

In this embodiment, light exited from the exit portion 12 is condensed via the microlenses M. Since the light is passed out from the line head 1' toward the outside with high effectiveness, emitted light having a high intensity (high brightness) can be obtained. Since the photosensitive drum 41 is exposed with light having a higher intensity while using a line head module 101' provided with the line head 1', the drawing quality of an image-forming apparatus described later can be heightened.

Additionally, in this embodiment, a method for producing the line head 1' includes an adhesion step of the microlens array M. In the method for producing the line head 1', steps other than this adhesion step are the same as in the first embodiment. A part of the description of the steps is omitted.

In the adhesion step of the microlens array M, the microlens array substrate MA (the microlens M) is caused to adhere to the side of the exit portion 12 of the head base 7, with the bonding layer 8 therebetween.

In more detail, the bonding layer 8 made of an epoxy resin is applied onto the head base 7 formed through the production process shown in FIG. 7A through FIG. 9B according to the method of screen printing or dispensing. The microlens array substrate MA is aligned with the head base 7, and is then caused to adhere to the head base 7 while being heated and pressed. Thus, the line head 1' is produced.

Operation Mode of Line Head Module

Next, the operation mode of the line head module 101 will be described.

The line head module 101 can be used as an exposure device of the image-forming apparatus of the present invention. In this case, the line head module 101 is disposed to face the photosensitive drum, and light emitted from the line head forms an upright same-size image on the photosensitive drum via the SL array.

A description will be hereinafter given of an embodiment concerning a tandem type and a four-cycle type image-forming apparatus.

Tandem Type Image-Forming Apparatus

First, a tandem type image-forming apparatus will be described.

Figure 11:
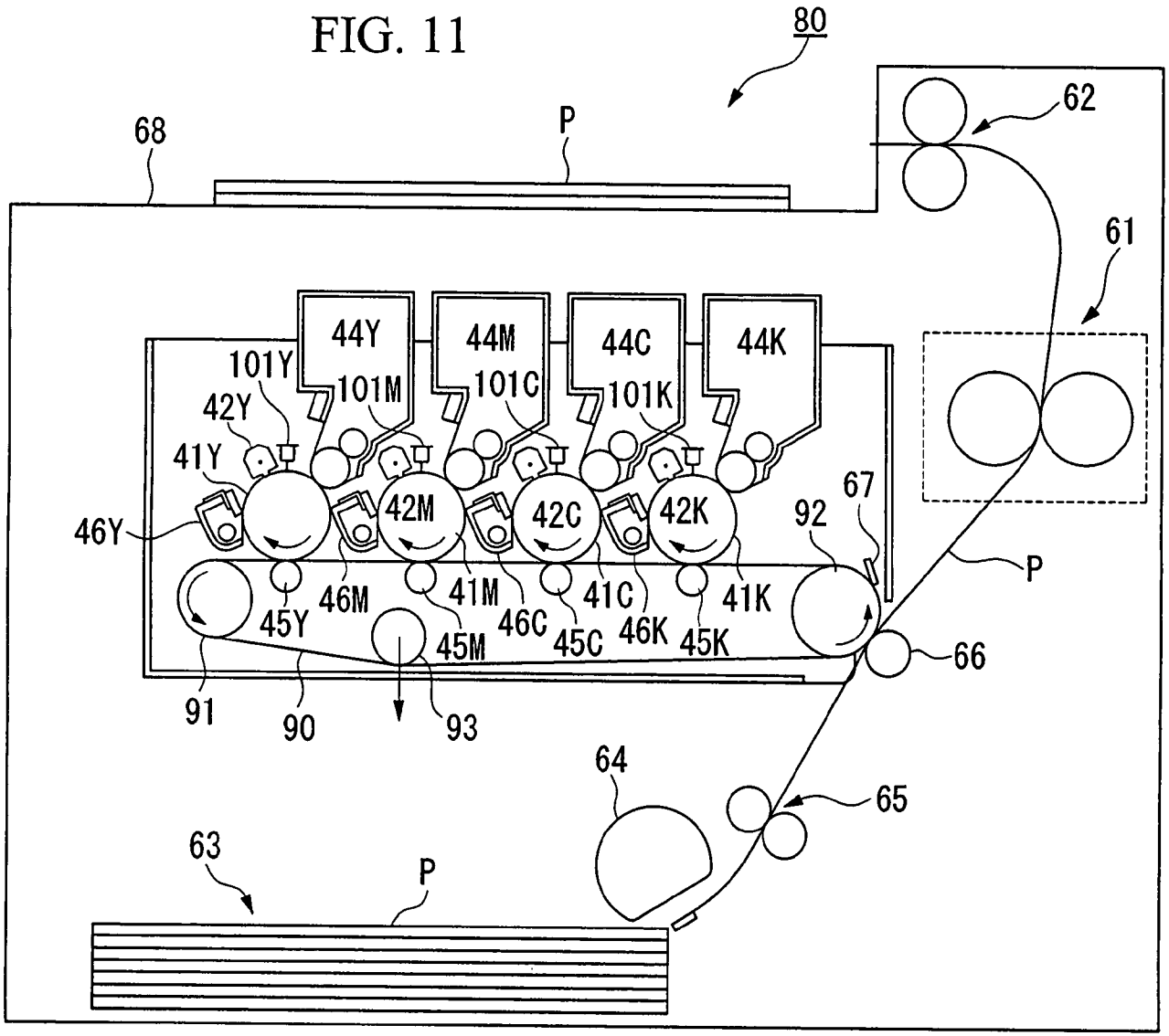
FIG. 11 is a schematic view of a tandem type image-forming apparatus.

FIG. 11 is a schematic view of the tandem type image-forming apparatus. In FIG. 11, reference numeral 80 designates the image-forming apparatus. This image-forming apparatus 80 is the tandem type, and includes four photosensitive drums (image carriers) 41K, 41C, 41M, and 41Y, the line head module 101 (which is also referred to as "line head modules 101K, 101C, 101M, and 101Y" in this embodiment) serving as an exposure device of the photosensitive drums 41K, 41C, 41M, and 41Y, and a charging means (corona charger) 42.

The image-forming apparatus 80 further includes an intermediate transfer belt 90, a driving roller 91, a driven roller 92, and a tension roller 93. In FIG. 11, the intermediate transfer belt 90 that is driven in a circulating manner in the direction of an arrow (i.e., in the counterclockwise direction) is stretched on the rollers. The photosensitive drums 41K, 41C, 41M, and 41Y are arranged with predetermined pitches along the intermediate transfer belt 90. Each of the outer peripheral surfaces of the photosensitive drums 41K, 41C, 41M, and 41Y is a photosensitive layer serving as an image carrier.

Reference characters K, C, M, and Y mentioned above designate black, cyan, magenta, and yellow, respectively. The photosensitive drums 41K, 41C, 41M, and 41Y are used for black, cyan, magenta, and yellow, respectively. Concerning the meanings of these reference characters (K, C, M, and Y), the same applies to the other members. The photosensitive drums 41K, 41C, 41M, and 41Y are rotationally driven in the direction of an arrow (in the clockwise direction) in FIG. 11 synchronously with the driving of the intermediate transfer belt 90.

A charging means 42 and the line head module 101 (K, C, M, and Y) are provided around each photosensitive drum 41 (K, C, M, and Y). The charging means 42 uniformly charges the outer peripheral surface of the photosensitive drum 41 (K, C, M, and Y) with electricity. The line head module 101 (K, C, M, and Y) sequentially subjects the outer peripheral surface of the photosensitive drum 41 (K, C, M, and Y) uniformly charged by the charging means 42 (K, C, M, and Y) to line scanning synchronously with the rotation of the photosensitive drum 41 (K, C, M, and Y).

The image-forming apparatus 80 further includes a developing device 44 (K, C, M, and Y), a primary transfer roller 45 (K, C, M, and Y), and a cleaning device 46 (K, C, M, and Y) used as a cleaning means. The developing device 44 (K, C, M, and Y) forms a visible image (a toner image) by providing a toner, which is a developing agent, to an electrostatic latent image formed by the line head module 101 (K, C, M, and Y). The primary transfer roller 45 (K, C, M, and Y) sequentially transfers the toner image developed by the developing device 44 (K, C, M, and Y) from the photosensitive drum 41 (K, C, M, and Y) to the intermediate transfer belt 90 that is a primary transfer subject. The cleaning device 46 (K, C, M, and Y) removes a toner remaining on the surface of the photosensitive drum 41 (K, C, M, and Y) from which the toner image has been transferred.

In the line head module 101 (K, C, M, and Y), the direction in which the organic EL devices are arranged is set along the generating line of the photosensitive drum 41 (K, C, M, and Y). Additionally, the light emission energy peak wavelength of the line head module 101 (K, C, M, and Y) is set to substantially coincide with the sensitivity peak wavelength of the photosensitive drum 41 (K, C, M, and Y).

For example, a non-magnetic one-component toner is used as the developing agent. In the developing device 44 (K, C, M, and Y), for example, a one-component developing agent is conveyed to a developing roller by use of a supply roller, and the film thickness of the developing agent that has adhered to the surface of the developing roller is restricted by a restricting blade. The developing roller is brought into contact with the photosensitive drum 41 (K, C, M, and Y), and/or is pressed thereagainst. As a result, the developing agent adheres to the photosensitive drum 41 (K, C, M, and Y) in accordance with an electric potential level, thus forming a toner image.

In FIG. 11, reference numeral 63 designates a paper feed cassette, reference numeral 64 designates a pickup roller, reference numeral 65 designates a gate roller pair, reference numeral 66 designates a secondary transfer roller used as a secondary transfer means, and reference numeral 67 designates a cleaning blade used as a cleaning means. The paper feed cassette 63 holds a plurality of recording mediums P stacked up. The pickup roller 64 feeds the recording mediums P one by one from the paper feed cassette 63. The gate roller pair 65 regulates a supply timing at which the recording mediums P are supplied to a secondary transfer part of the secondary transfer roller 66. The secondary transfer roller 66 forms the secondary transfer part in cooperation with the intermediate transfer belt 90. The cleaning blade 67 removes a toner remaining on the surface of the intermediate transfer belt 90 after the secondary transfer is completed.

A black toner image, a cyan toner image, a magenta toner image, and a yellow toner image formed by a station for forming four single-color toner images are primarily transferred onto the intermediate transfer belt 90 in sequence by a primary transfer bias applied to the primary transfer roller 45 (K, C, M, and Y). The toner images are sequentially superimposed on each other on the intermediate transfer belt 90, and a resulting full-color toner image is secondarily transferred onto the recording medium P, such as a sheet of paper, by use of the secondary transfer roller 66. The toner image is fixed to the recording medium P by allowing the recording medium P to pass through a fixing roller pair 61 serving as an image fixing part. Thereafter, the recording medium P is discharged to a catch tray 68 provided on the upper part of the apparatus via a paper ejecting roller pair 62.

Four-Cycle Type Image-Forming Apparatus

Next, a four-cycle type image-forming apparatus will be described.

Figure 12:
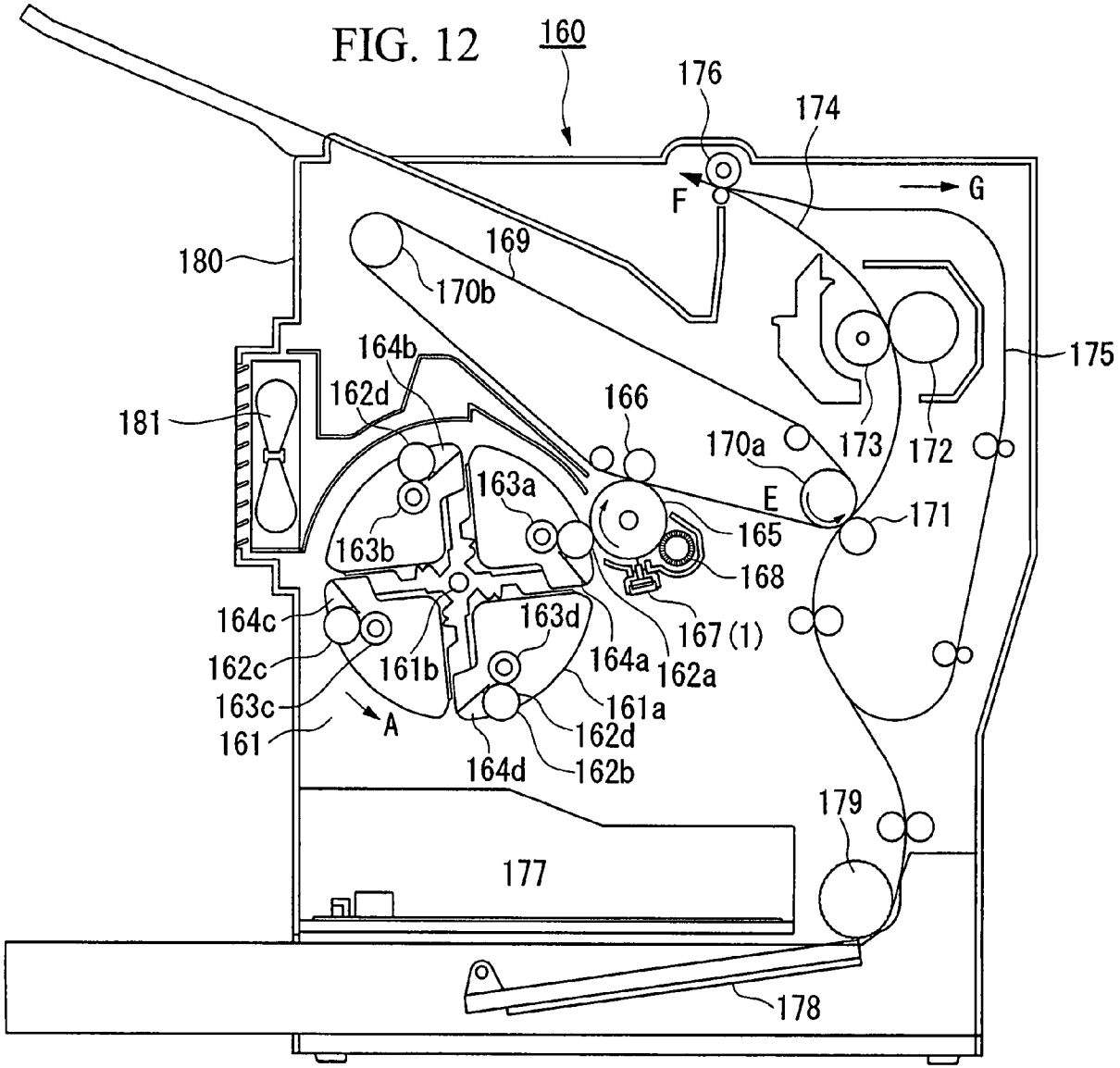
FIG. 12 is a schematic view of a four-cycle type image-forming apparatus.

FIG. 12 is a schematic view of the four-cycle type image-forming apparatus. In FIG. 12, an image-forming apparatus 160 includes main constituent members, i.e., a developing device 161 having a rotary structure, a photosensitive drum 165 that functions as an image carrier, a line head module 167 that functions as an image writing means (exposure means), an intermediate transfer belt 169, a paper conveying path 174, a heating roller 172 of a fixing device, and a paper feed tray 178.

In the developing device 161, a developing rotary 161*a* rotates in the direction of arrow "A" on a shaft 161*b*. The inside of the developing rotary 161*a* is divided into four parts consisting of four color image-forming units, i.e., a yellow (Y) image-forming unit, a cyan (C) image-forming unit, a magenta (M) image-forming unit, and a black (K) image-forming unit. The four image-forming units include developing rollers 162*a* to 162*d*, toner supply rollers 163*a* to 163*d*, and restricting blades 164*a* to 164*d* that restrict a toner to a predetermined thickness, respectively.

In FIG. 12, reference numeral 165 designates a photosensitive drum that functions as an image carrier as described above, reference numeral 166 designates a primary transfer member, and reference numeral 168 designates a charger. Reference numeral 167 designates a line head module that functions as an image writing means (exposure means). The photosensitive drum 165 is rotationally driven by a driving motor, such as a step motor, not shown.

An intermediate transfer belt 169 is stretched from a driving roller 170*a* to a driven roller 170*b*. The driving roller 170*a* is connected to the driving motor of the photosensitive drum 165, thereby transmitting the power to the intermediate transfer belt 169. In other words, the driving roller 170*a* of the intermediate transfer belt 169 is rotated in the direction of arrow "E", which is opposite to the direction in which the photosensitive drum 165 rotates, by driving the driving motor.

A plurality of carrier rollers, a paper ejecting roller pair 176, etc., are provided on a paper conveying path 174. Sheets of paper are conveyed along the paper conveying path 174. An image (a toner image) carried by the intermediate transfer belt 169 is transferred to one side of a sheet of paper at the position of a secondary transfer roller 171. The secondary transfer roller 171 can be brought into contact with the intermediate transfer belt 169, and can be separated therefrom by use of a clutch. The secondary transfer roller 171 is brought into contact with the intermediate transfer belt 169 in response to "ON" of the clutch, and the image is transferred to the sheet of paper.

The sheet of paper to which the image has been transferred as described above is subjected to fixing processing by a fixing device including a fixing heater H. The fixing device additionally includes a heating roller 172 and a pressing roller 173. The sheet of paper that has undergone the fixing processing is pulled into the paper ejecting roller pair 176, and is allowed to proceed in the direction of arrow "F". When the paper ejecting roller pair 176 is rotated in the opposite direction from this state, the sheet of paper reverses the proceeding direction, and proceeds in the direction of arrow "G" along a conveying path 175 used for double-side printing. Reference numeral 177 designates an electric equipment box, reference numeral 178 designates a paper feed tray that stores sheets of paper, and reference numeral 179 designates a pickup roller provided at the outlet of the paper feed tray 178.

In the paper conveying path, for example, a low-speed brushless motor is used as the driving motor that drives the carrier roller. Preferably, a step motor is used for the intermediate transfer belt 169, based on needs, such as correction for a color blur. These motors are controlled by signals sent from a control means not shown.

A yellow (Y) electrostatic latent image is formed on the photosensitive drum 165 in the state shown in FIG. 12, and a high voltage is applied to the developing roller 162*a*, and, as a result, a yellow image is formed on the photosensitive drum 165. When the reverse-side and obverse-side yellow images are all carried by the intermediate transfer belt 169, the developing rotary 161*a* rotates in the direction of arrow "A" by 90 degrees.

The intermediate transfer belt 169 makes one rotation, and returns to the position of the photosensitive drum 165. Thereafter, double-side cyan (C) images are formed on the photosensitive drum 165, and are carried while being superimposed on the yellow image carried by the intermediate transfer belt 169. In the same way as above, repeatedly, the developing rotary 161 rotates by 90 degrees, and the intermediate transfer belt 169 makes one rotation after the image is carried.

The intermediate transfer belt 169 makes four rotations in order to carry four color images. The sheet of paper fed from the paper feed tray 178 is conveyed along the conveying path 174. An image is transferred to one side of the sheet of paper from the intermediate transfer belt 169 by use of the secondary transfer roller 171 while controlling the rotational position of the intermediate transfer belt 169. The sheet of paper having one side to which the image has been transferred is reversed by the paper ejecting roller pair 176 as described above, and stands by on the conveying path. Thereafter, the sheet of paper is conveyed to the position of the secondary transfer roller 171 at an appropriate timing, and the color image mentioned above is transferred to the other side of the sheet of paper. An exhaust fan 181 is provided in a housing 180.

The image-forming apparatuses 80 and 160 of FIG. 11 and FIG. 12 include the line head module 101 of the present invention that is shown in FIG. 1 and that is used as an exposure means.

Therefore, in the image-forming apparatuses 80 and 160, emission light having a high intensity can be passed out from the exit portion 12 provided on the end surface of the head base 7 as described above, and hence the printing performance of the image-forming apparatus can be heightened, and a high-quality print can be obtained.

The image-forming apparatus including the line head module can be variously modified without being limited to the above embodiments. For example, in the image-forming apparatus, instead of the line head module 101, the line head module 101' provided with the line head 1' having the microlens array substrate MA may be used as an exposure means.

The preferred embodiments of the present invention have been described as above. However, the present invention is not limited to these embodiments. Various modifications, such as the addition, removal, and replacement of the constituent members, can be made within the scope not departing from the gist of the present invention. The present invention is limited only by the appended claims, not by the description given above.

What is claimed is:

1. A line head, comprising:

a first substrate having a plurality of organic electroluminescent devices;

a bonding layer disposed on the first substrate and having optical transparency;

a second substrate bonded to the first substrate with the bonding layer therebetween and having a reflective film that covers at least a part of the bonding layer; and a plurality of exit portions respectively from which light emitted from the organic electroluminescent devices that has passed through the bonding layer exits, wherein the light from each of the exit portions travels along a first direction substantially parallel to an emission surface of the first substrate, and wherein a cross section in a second direction of the reflective film has a substantially concave shape, the second direction intersecting the first direction.

2. The line head according to claim 1, wherein the second substrate faces an emission side of the first substrate.

3. The line head according to claim 1, wherein the bonding layer has elongated areas.

4. The line head according to claim 3, wherein each of the exit portions is located at an end of each of the elongated areas.

5. The line head according to claim 1, further comprising a plurality of microlenses each of which corresponds to each of the exit portions.

6. The line head according to claim 5, further comprising:

a head base having the first substrate, the bonding layer, and the second substrate; and a microlens array substrate having the microlenses and bonded to the head base with an adhesive material therebetween, the bonding layer being the same material as the adhesive material.

7. An image-forming apparatus, comprising:

the line head according to claim 1; and a photosensitive drum exposed to the line head.

8. The line head according to claim 1, wherein the cross section in the second direction of the reflective film has a substantially half-circle shape.

9. A line head comprising:

a first substrate having a plurality of organic electroluminescent devices;

a bonding layer disposed on the first substrate and having optical transparency;

a second substrate bonded to the first substrate with the bonding layer therebetween and having a reflective film that covers at least a part of the bonding layer;

a plurality of exit portions respectively from which light emitted from the organic electroluminescent devices that has passed through the bonding layer exits; and a microlens array substrate having a plurality of microlenses each of which corresponds to each of the exit portions, wherein the microlens array substrate is bonded to a head base with an adhesive material therebetween, the head base includes the first substrate, the bonding layer, and the second substrate, the bonding layer is the same material as the adhesive material, and the light from each of the exit portions travels along a first direction substantially parallel to an emission surface of the first substrate.

10. The line head according to claim 9, wherein the bonding layer has substantially parallel linear portions along an axis direction, and wherein a cross section in a second direction of the reflective film has a substantially concave shape, the second direction intersecting the axis direction.

* * * * *